US010350663B2

(12) United States Patent
Itaoka et al.

(10) Patent No.: US 10,350,663 B2
(45) Date of Patent: Jul. 16, 2019

(54) PRESS APPARATUS

(71) Applicant: KEYLEX CORPORATION, Hiroshima (JP)

(72) Inventors: Tsuyoshi Itaoka, Hiroshima (JP); Shigeki Teshima, Hiroshima (JP)

(73) Assignee: KEYLEX CORPORATION, Hiroshima (JP)

( * ) Notice: Subject to any disclaimer, the term of this patent is extended or adjusted under 35 U.S.C. 154(b) by 689 days.

(21) Appl. No.: 14/851,423

(22) Filed: Sep. 11, 2015

(65) Prior Publication Data

US 2016/0008864 A1 Jan. 14, 2016

Related U.S. Application Data

(63) Continuation of application No. PCT/JP2013/002276, filed on Apr. 2, 2013.

(51) Int. Cl.

| | |
|---|---|
| ***B21D 22/02*** | (2006.01) |
| ***B21D 22/21*** | (2006.01) |
| ***B21D 24/02*** | (2006.01) |
| ***B21D 24/06*** | (2006.01) |
| ***B21D 24/12*** | (2006.01) |

(Continued)

(52) U.S. Cl.

CPC ..... *B21D 22/02* (2013.01); *B21D 22/21* (2013.01); *B21D 24/02* (2013.01); *B21D 24/16* (2013.01); *B21D 28/24* (2013.01); *B21D 35/001* (2013.01); *B21D 45/02* (2013.01);

(Continued)

(58) Field of Classification Search

CPC ..... B21D 24/16; B21D 28/24; B21D 35/001; B21D 22/21; B21D 45/00; B21D 22/02–10; B21D 22/22; B21D 24/02–16; B30B 15/0076

See application file for complete search history.

(56) References Cited

U.S. PATENT DOCUMENTS

2010/0126640 A1* 5/2010 Fang ..... B21D 24/16 148/559
2011/0252856 A1* 10/2011 Matsuda ..... B21D 22/022 72/364

FOREIGN PATENT DOCUMENTS

JP 7-16336 A 1/1995
JP 1119728 A * 1/1999

(Continued)

OTHER PUBLICATIONS

Machine Translation of JP 11-019728, Translated Nov. 17, 2017, 2 Pages.*

(Continued)

*Primary Examiner* — Gregory D Swiatocha
(74) *Attorney, Agent, or Firm* — Alston & Bird LLP

(57) ABSTRACT

Provided is a press apparatus which ensures high production efficiency and has less chances of breakdown. Specifically, the press apparatus has a base placed on a floor, and a platform arranged over the base to face the base and move up and down. A lower die, on which a steel plate is to be placed, is fixed to the base. An upper die is fixed to the platform to press the plate against the lower die and turn it into an initially formed product through a downward movement of the platform, and to pressure-hold the initially formed product with the lower die. A machining die is supported on the platform to move up and down to machine the initially formed product and form a final product by (Continued)

moving down while pressure-holding the initially formed product.

4 Claims, 5 Drawing Sheets

(51) Int. Cl.

| | |
|---|---|
| ***B21D 24/14*** | (2006.01) |
| ***B21D 24/16*** | (2006.01) |
| ***B21D 28/24*** | (2006.01) |
| ***B21D 35/00*** | (2006.01) |
| ***B21D 45/02*** | (2006.01) |
| ***B21D 15/00*** | (2006.01) |
| ***B30B 15/00*** | (2006.01) |

(52) U.S. Cl.
CPC ..... *B30B 15/0076* (2013.01); *B21D 24/06* (2013.01); *B21D 24/12* (2013.01); *B21D 24/14* (2013.01)

(56) References Cited

FOREIGN PATENT DOCUMENTS

| | | | | |
|---|---|---|---|---|
| JP | H11-19728 | A | | 1/1999 |
| JP | 2000158057 | A | * | 6/2000 |
| JP | 2000-233234 | A | | 8/2000 |
| JP | 2000233234 | A | * | 8/2000 |
| JP | 2006-122996 | A | | 5/2006 |
| JP | 2006-205232 | A | | 8/2006 |
| JP | 2011-092946 | A | | 5/2011 |
| JP | 2011161469 | A | * | 8/2011 |
| JP | 2011-218436 | A | | 11/2011 |

OTHER PUBLICATIONS

Machine Translation of JP2000233234, 5 Pages.*
International Searching Authority, International Search Report (ISR) and Written Opinion for International Application No. PCT/JP2013/002276, dated Jul. 2, 2013, 9 pages, Japan Patent Office, Japan.

* cited by examiner

PRESS APPARATUS

CROSS-REFERENCE TO RELATED APPLICATION

This application is a continuation of and claims priority to and the benefit of International Application No. PCT/JP2013/002276, filed Apr. 2, 2013; the contents of which is hereby incorporated by reference in its entirety.

BACKGROUND

Related Field

The present invention relates to a press apparatus in which a steel plate is pressed into an initially formed product, and the initially formed product is machined while it is being pressure-held in order to obtain a final product.

Recently, in automobile industries, there is a growing demand for lightweight and high-safety vehicle body structures. To fulfill this demand, pressed products to form a vehicle body have been formed of a high tensile strength steel plate, or been formed by a hot-pressing method.

For example, the press apparatus of Japanese Unexamined Patent Publication No. 2011-92946 (Paragraphs 0015-0029 and FIGS. 1-4)) forms a pressed product by a hot pressing method. A steel plate, which has been heated to a hardening temperature, is pressed with an upper die and a lower die by moving down a platform on which the upper die is supported, thereby forming an initially formed product. The initially formed product is then pressure-held and hardened. During this hardening process, the platform is moved further down, with the upper die removed from the platform and put on the lower die, thereby machining the initially formed product with a trim die fixed to the platform, and obtaining a final product.

In press apparatuses, such as the one disclosed in Japanese Unexamined Patent Publication No. 2011-92946, the upper die is supported on the platform by inserting a support rod, which extends upward from the upper die, into an inner space of the platform, and interposing a block, which is fixed to an end of a piston rod of a fluid pressure cylinder, between a contact member provided on a top wall of the inner space of the platform and the upper end of the support rod. Thus, in machining the initially formed product with a trim die, the state of pressure-holding the initially formed product needs to be temporarily stopped to cause the platform to move upward for a moment, and allow the block to move backward by a shrinkage movement of the fluid pressure cylinder, in order that the upper die can be removed from the platform. This increases the number of movements of the apparatus and, hence, the production time.

Further, in the press apparatuses, such as the one disclosed in Japanese Unexamined Patent Publication No. 2011-92946, a heavy load is applied, during the pressure holding, to a portion of a complicated structure where the support rod, the contact member, and the block are combined together. This may cause breakdowns more frequently in this portion, and cause an increase in the number of times of maintenance.

BRIEF SUMMARY

In view of the foregoing background, it is therefore an object of the present invention to provide a press apparatus with high production efficiency and less chances of breakdown.

To achieve the above object, the present invention provides a structure in which an upper die does not move up and down with respect to a platform.

Specifically, a first aspect of the invention includes: a base placed on a floor; a platform arranged over the base to face the base and move up and down; a lower die which is fixed to the base and on which a steel plate is to be mounted; an upper die fixed to the platform to press the steel plate against the lower die and turn the plate into an initially formed product through a downward movement of the platform, and to pressure-hold the initially formed product with the lower die; and a machining die supported on the platform to move up and down and to machine the initially formed product and form a final product by moving downward while pressure-holding the initially formed product between the upper and lower dies.

A second aspect of the invention is an embodiment of the first aspect of the invention. In the second aspect, a plurality of rods are provided around the machining die so as to extend vertically, and to move downward synchronously with the downward movement of the machining die, and a plurality of shock absorber means are provided on the base at positions corresponding to the rods to absorb a shock caused when the steel plate is pressed and a shock caused when the initially formed product is machined.

A third aspect of the invention is an embodiment of the first or second aspect of the invention. In the third aspect, the upper die is provided with a horizontally-extending through hole and a pierce hole vertically extending from the through hole to a die surface, and the machining die includes: a plurality of trim dies arranged around the upper die to cut off outer peripheral portions of the initially formed product; a pierce die arranged in the pierce hole to move forward and backward and make a hole through the initially formed product; and a coupling member inserted in the through hole to move up and down and connected to an upper end of the pierce die so as to couple at least two of the trim dies facing each other.

According to the first aspect of the invention, the upper die is fixed to the platform, and the machining die moves up and down with respect to the platform. This thus allows the machining die to machine the initially formed product, while keeping pressure-holding the initially formed product between the upper and lower dies, without the need to temporarily move up the platform as in Patent Document 1 in order to pressure-hold the product. This allows for improving production efficiency. Further, unlike Japanese Unexamined Patent Publication No. 2011-92946 having a complicated structure in which a support rod, a contact member, and a block are combined together, the structure of the present invention is a simple one with no such complicated structure. This prevents an excessive load from being applied to any specific part of the structure during the pressure holding of the product. As a result, breakdowns of the apparatus are avoidable, and therefore, the frequency of maintenance is reducible.

According to the second aspect of the invention, swing of the upper die, lower die, and machining die to be caused when pressing and machining the product is reduced. Thus, the load on the apparatus is further reduced compared to the first aspect of the invention, thereby preventing breakdowns of the apparatus. Further, the machining die is moved down while upward tension is being applied to the hydraulic press machines by the respective shock absorbers. This allows the machining die to move down when the hydraulic press machines have predetermined uniform hydraulic pressure, and hence allows the machining die to move down smoothly, thereby further reducing breakdowns of the apparatus.

According to the third aspect of the invention, while the outer peripheral portions of the initially formed product are being cut off by the trim dies moving down, the pierce die is simultaneously moved forward, thereby making a hole at an inner portion of the initially formed product. This means that the trimming and the piercing do not have to be performed independently, and the production time is therefore further reduced, compared to the first aspect of the invention. Further, it is not necessary to provide any drive source for moving the pierce die forward. It is thus possible to provide a low-cost apparatus.

DETAILED DESCRIPTION OF VARIOUS EMBODIMENTS

Various embodiments of the present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. The term "or" is used herein in both the alternative and conjunctive sense, unless otherwise indicated. The terms "illustrative" and "exemplary" are used to be examples with no indication of quality level. Like numbers refer to like elements throughout.

Figure 1:
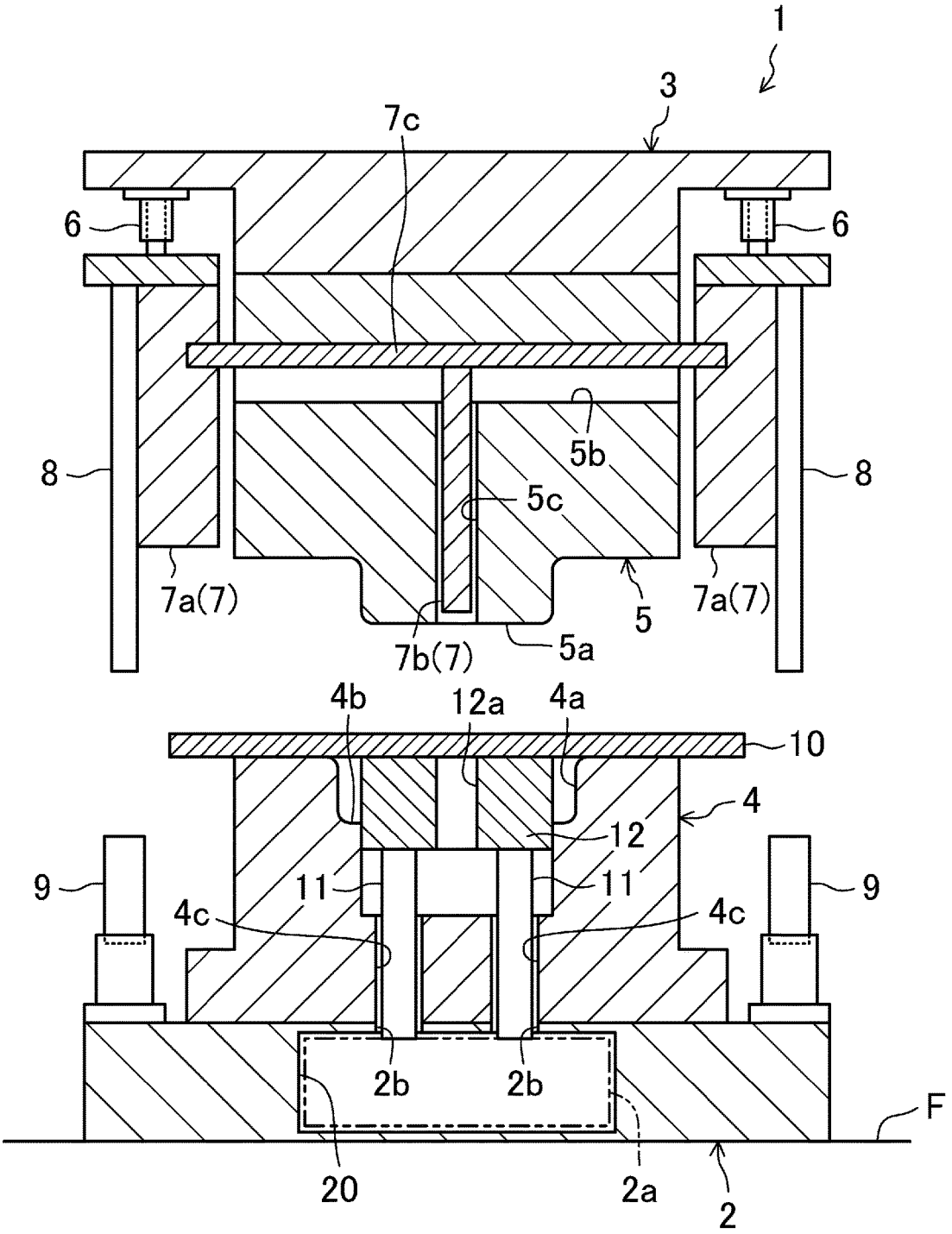
FIG. 1 illustrates a press apparatus according to an embodiment of the present invention.

FIG. 1 illustrates a press apparatus 1 according to an embodiment of the present invention. The press apparatus 1 is intended to form a pressed product by a hot pressing method, and has a base 2 placed on the floor F, and a platform 3 arranged over the base 2 to move up and down under the control of a servomotor (not shown).

A housing space 20 is formed in a central portion of the base 2. A die cushion 2*a* is housed in the housing space 20.

A plurality of base pin holes 2*b* are provided to be open at a central portion of the upper surface of the base 2, and extend vertically to pass through the upper surface of the base 2 and reach the housing space 20.

A lower die 4, on which a steel plate 10 heated to a hardening temperature is to be mounted, is fixed to the central portion of the upper surface of the base 2. The lower die 4 is provided, at its central portion, with a recess 4*a* which is open upward.

An upper half of the inner peripheral surface of the recess 4*a* expands horizontally outward with respect to a lower half thereof, thereby creating a step 4*b* between the upper and lower halves of the recess 4*a*.

A cushion die 12, of which the shape matches that of the lower half of the recess 4*a*, is fitted into the lower half of the recess 4*a* so as to allow the cushion die 12 to move forward and backward vertically. The cushion die 12 is provided with a through hole 12*a* that has been cut through its central portion to run vertically.

A plurality of lower die pin holes 4*c* corresponding to the respective base pin holes 2*b* are provided through the bottom of the recess 4*a*. A cushion pin 11 is fitted into each of the base pin holes 2*b* and a corresponding one of the lower die pin holes 4*c* so as to slide up and down through the holes 2*b* and 4*c*.

Each of the cushion pins 11 is interposed between the cushion die 12 and the die cushion 2*a*. The upward movement of the cushion pins 11 causes the cushion die 12 to move forward (or upward) and reach a position in which the upper end face of the cushion die 12 is flush with the upper end face of the lower die 4. The backward movement of the cushion pins 11 causes the cushion die 12 to move backward (or downward) and reach a position in which the lower end face of the cushion die 12 is in contact with the bottom face of the recess 4*a*, and the upper end face of the cushion die 12 is flush with the step 4*b*. This means that a die surface 4*d* is formed by the upper end face of the cushion die 12 and the step 4*b*.

An upper die 5 having a die surface 5*a* of which a cross section has a protrusion approximately in the middle, is fixed to the platform 3 at such a position as to face the lower die 4.

The upper die 5 is provided with an upper die through hole 5*b* extending horizontally, and a pierce hole 5*c* extending vertically from a longitudinal middle of the upper die through hole 5*b* to the machining surface 5*a*.

Figure 2:
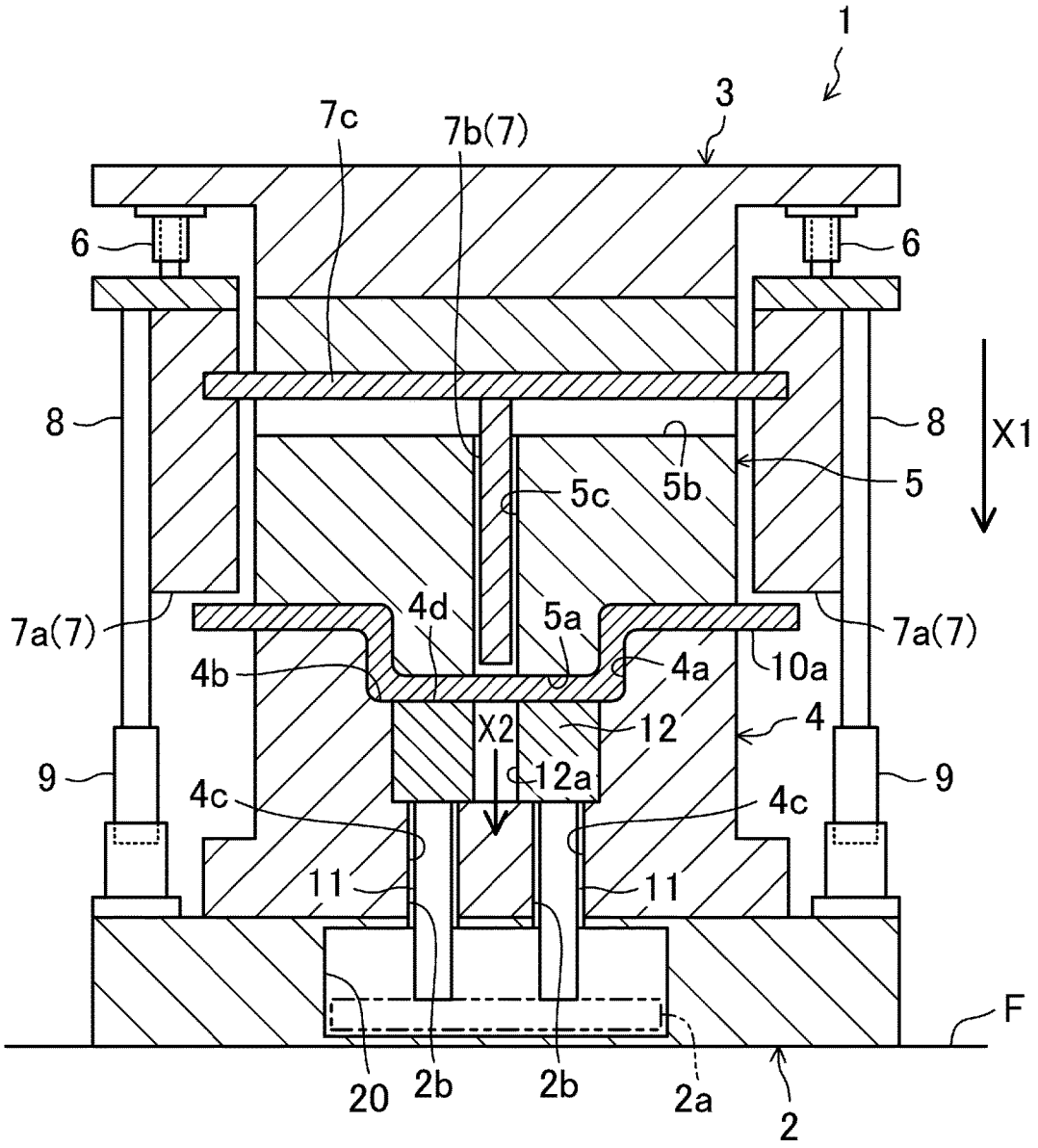
FIG. 2 illustrates a state where an initially formed product has just been formed by pressing a steel plate with an upper die and a lower die with a platform moved down from the position illustrated in FIG. 1.

As illustrated in FIG. 2, the upper die 5 is configured to press the heated steel plate 10 against the lower die 4 and turn it into an initially formed product 10*a* through a downward movement of the platform 3 and is also configured to pressure-hold the initially formed product 10*a* between the upper die 5 and the lower die 4 for hardening the product 10*a*.

A plurality of hydraulic press machines 6 are fixed to the platform 3 around the upper die 5. Trim dies 7*a* extending vertically are supported on the hydraulic press machines 6 so as to move up and down.

An elongated round-bar pierce die 7*b* is inserted in the pierce hole 5*c* so as to move forward and backward in the upward and downward directions.

Further, a rod-like coupling member 7*c* is inserted in the upper die through hole 5*b* so as to move up and down. A longitudinal middle portion of the coupling member 7*c* is connected to the upper end of the pierce die 7*b*. Both of the ends of the coupling member 7*c* are respectively coupled to two of the trim dies 7*a* facing each other.

Figure 3:
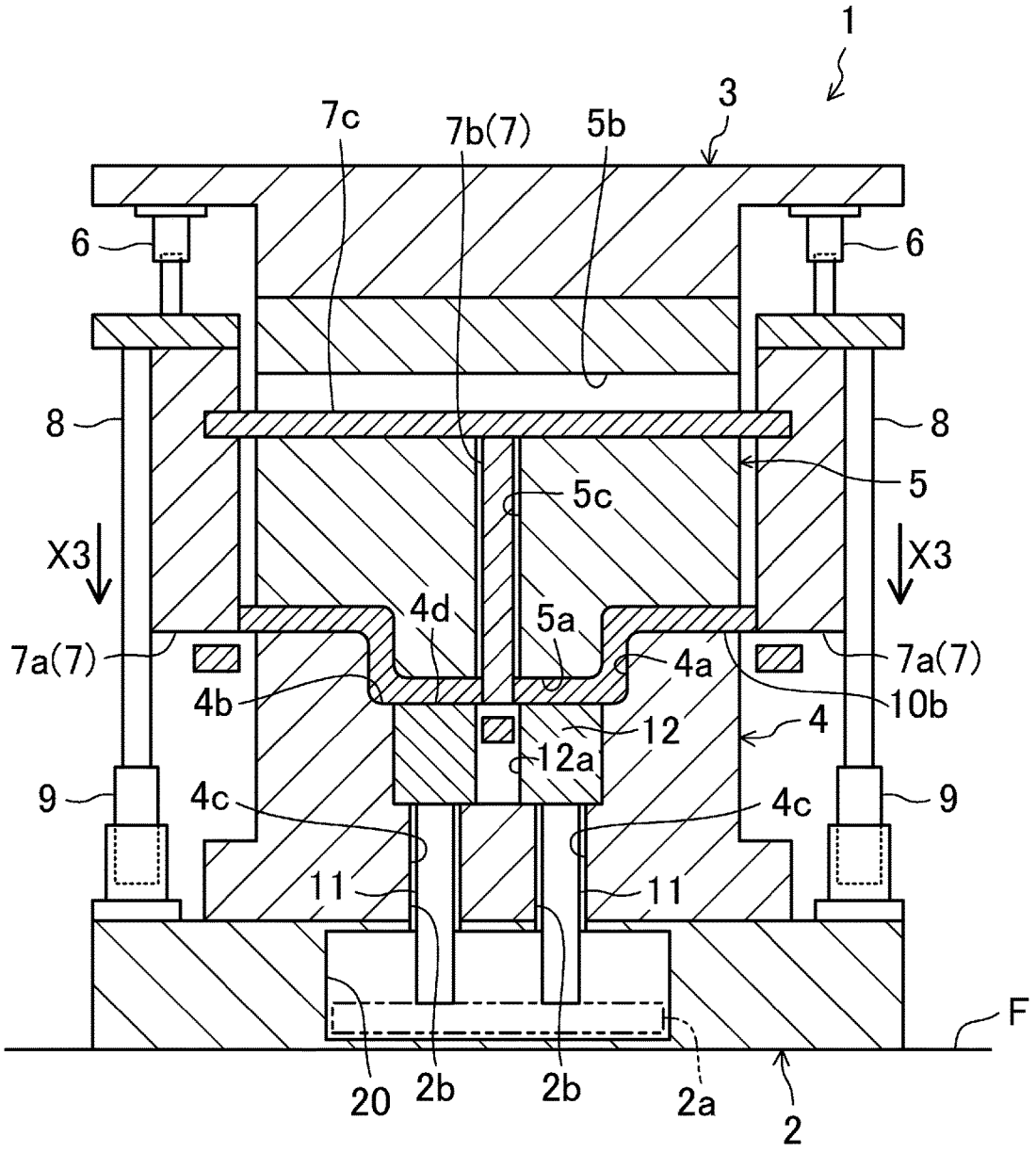
FIG. 3 illustrates a state where a final product has just been obtained by machining the initially formed product with a machining die moved further downward from the position illustrated in FIG. 2.

The trim dies 7*a* and the pierce die 7*b* form a machining die 7 according to the present invention. While the initially formed product 10*a* is being pressure-held between the upper die 5 and the lower die 4, the trim dies 7*a* move down to cut off outer peripheral portions of the initially formed product 10*a*, and the pierce die 7*b* moves forward to make a hole in the initially formed product 10*a*, as illustrated in FIG. 3.

That is, the initially formed product 10*a* is machined through the downward movement of the machining die 7, thereby obtaining a final product 10*b*.

A rod 8 is fixed to the side surface of each trim die 7*a* so as to extend vertically. The lower end of each rod 8 is positioned below the die surface 5*a* of the upper die 5.

On the other hand, a shock absorber 9 (a shock absorber mean) is fixed to the base 2 at a position corresponding to each rod 8. In pressing the heated steel plate 10 between the upper die 5 and the lower die 4 by moving down the platform 3, the lower end of the rod 8 contacts with the shock absorber 9, and the shock is thus absorbed by the shock absorber 9. Also in machining the initially formed product 10*a* by the machining die 7 that is moving down, the shock absorber 9 is compressed by the rod 8 to absorb the shock.

Now, it will be described how to form the final product 10*b* from the heated steel plate 10 using this press apparatus 1.

FIG. 1 illustrates a state where the steel plate 10 heated, for example, in a furnace is loaded between the upper die 5 and the lower die 4 that are now open. In this state, the trim dies 7*a* is moved upward with respect to the upper die 5, and the pierce die 7*b* is set back in the upward direction with respect to the upper die 5. Further, the upward movement of the cushion pins 11 causes the cushion die 12 to move forward in the upward direction with respect to the lower die 4, so that the upper end face of the cushion die 12 is now flush with the upper end face of the lower die 4.

From this state illustrated in FIG. 1, the platform 3 is moved down first (as indicated by the arrow X1) as shown in FIG. 2. Then, as the upper die 5 and the lower die 4 press the heated steel plate 10, a central portion of the plate 10 is pressed downward by the die surface 5*a* of the upper die 5, thus causing the cushion die 12 to gradually move back in the downward direction (as indicated by the arrow X2) against the biasing force of the die cushion 2*a*. The cushion die 12 soon comes in contact with the bottom face of the recess 4*a*, when an initially formed product 10*a* is obtained between the upper die 5 and the lower die 4. At this time, the respective lower ends of the rods 8 are brought into contact with the respective shock absorbers 9, thereby absorbing a shock. After that, the initially formed product 10*a* is hardened by being pressure-held and quenched between the upper die 5 and the lower die 4.

Then, from their positions shown in FIG. 2, the trim dies 7*a* are moved down, and the pierce die 7*b* is moved forward. As a result, as illustrated in FIG. 3, the trim dies 7*a* cut off the outer peripheral portions of the initially formed product 10*a*, and the pierce die 7*b* makes a hole in the initially formed product 10*a* (as indicated by the arrow X3). At this moment, the trim dies 7*a* and the pierce die 7*b* are moved down while upward tension is being applied to the hydraulic press machines 6 by the respective shock absorbers 9. This allows the trim dies 7*a* and the pierce die 7*b* to move down when the hydraulic press machines 6 have predetermined uniform hydraulic pressure, and hence allows them to move down smoothly. This prevents the press apparatus 1 from causing a breakdown.

When a predetermined period of time passes since the state shown FIG. 3 has been established, the hardening of the initially formed product 10*a* is finished between the upper die 5 and the lower die 4, and a final product 10*b* is obtained. Then, the trim dies 7*a* and the pierce die 7*b* are moved upward (as indicated by the arrow X5) by the hydraulic press machines 6, and the platform 3 is moved up to separate the die surface 5*a* of the upper die 5 from the top face of the final product 10*b* (as indicated by the arrow X4) as illustrated in FIG. 4.

Figure 4:
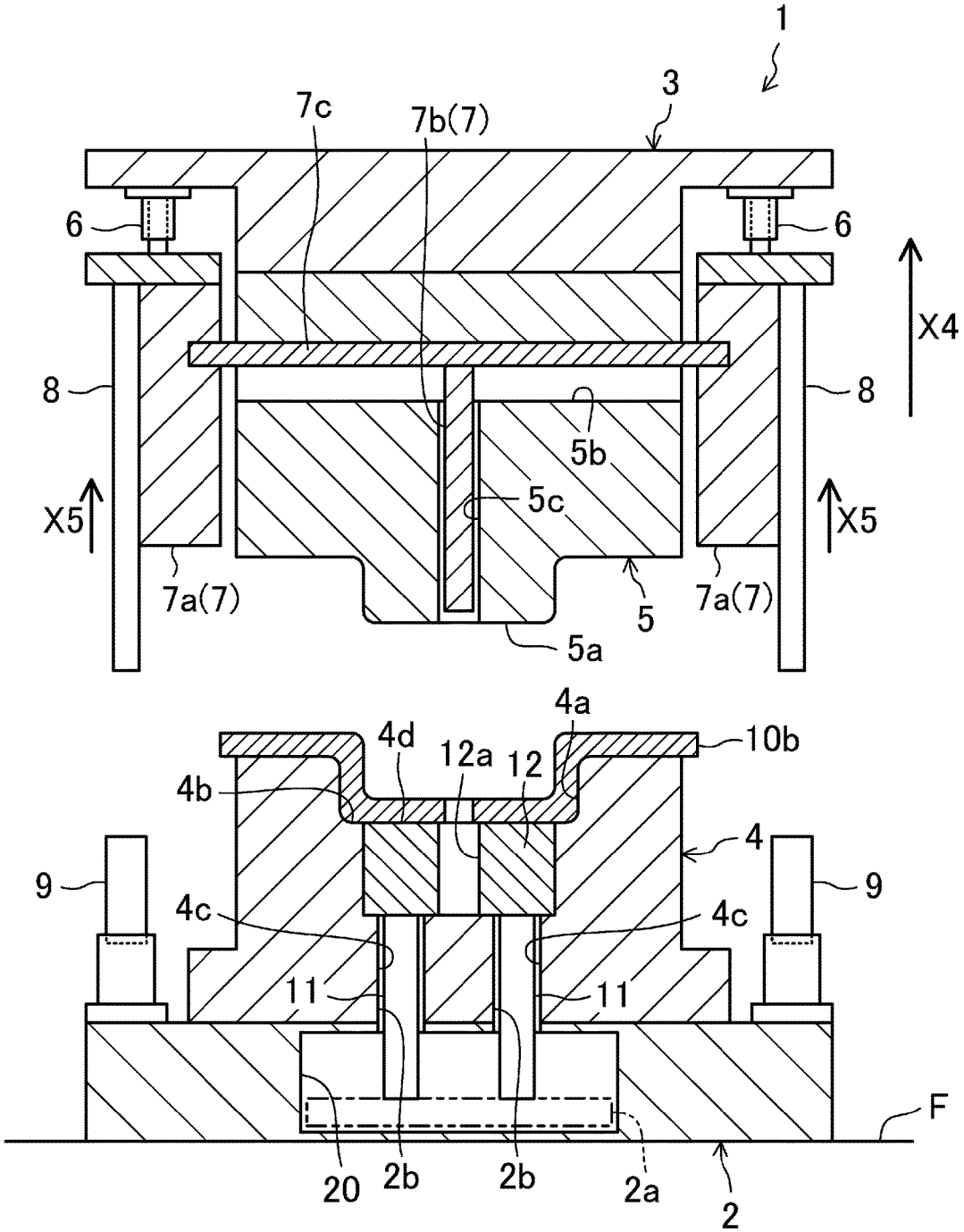
FIG. 4 illustrates a state where the machining die and the platform have just moved up from their positions illustrated in FIG. 3.
Figure 5:
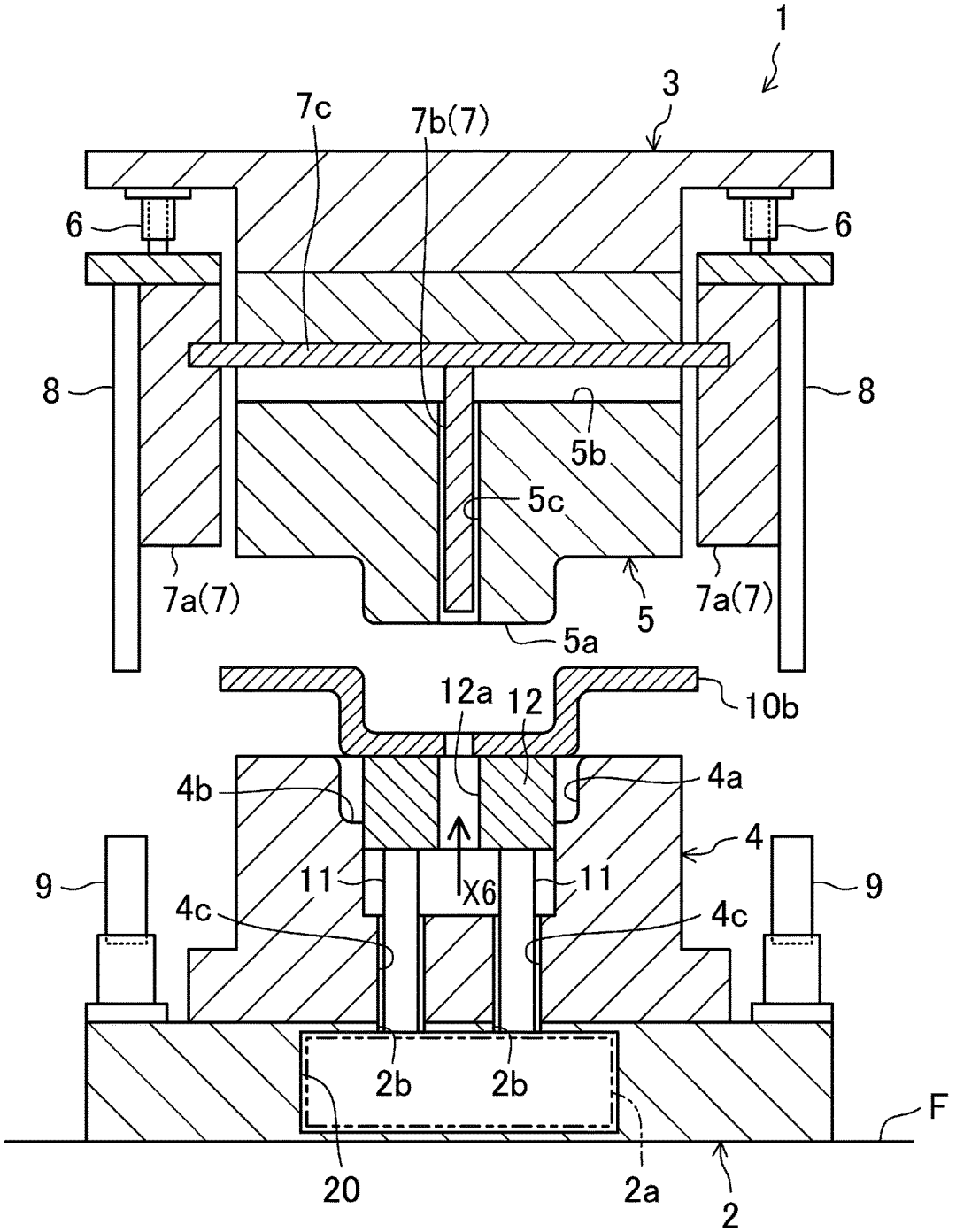
FIG. 5 illustrates a state where the final product has been lifted up by a cushion die from its position on the lower die as illustrated in FIG. 4.

Thereafter, from their positions shown in FIG. 4, the cushion die 12 is moved forward in the upward direction by the die cushion 2*a* and the cushion pins 11, and the final product 10*b* is therefore lifted and removed from the lower die 4 as illustrated in FIG. 5. After that, the final product 10*b* is unloaded from between the upper die 5 and the lower die 4 (as indicated by the arrow X6).

As can be seen from the foregoing description, according to an embodiment of the present invention, the upper die 5 is fixed to the platform 3, and the trim dies 7*a* and the pierce die 7*b* are moved up and down with respect to the platform 3. This thus allows for machining the initially formed product 10*a* with the trim dies 7*a* and the pierce die 7*b* while the initially formed product 10*a* is being pressure-held between the upper die 5 and the lower die 4, without any need to temporarily move up the platform 3 as in Patent Document 1 in pressure-holding the product. Consequently, the production efficiency is improvable.

Further, unlike Patent Document 1 having a complicated structure in which a support rod, a contact member, and a block are combined together, the structure of the above embodiment is a simple one with no such complicated structure. This prevents an excessive load from being applied to any specific part of the structure during the pressure holding of the product. As a result, breakdowns of the press apparatus 1 are avoidable, and therefore, the frequency of maintenance is reducible.

Furthermore, the shock absorber 9 reduces the swing of the upper die 5, lower die 4, trim dies 7*a*, and pierce die 7*b* to be caused when pressing and machining the product. Thus, the load on the press apparatus 1 is further reduced, thereby preventing breakdowns of the press apparatus 1.

In addition, while the outer peripheral portions of the initially formed product 10*a* are being cut off by the trim dies 7*a* moving down, the pierce die 7*b* is simultaneously moved forward, thereby making a hole at an inner portion of the initially formed product 10*a*. This means that the trimming and the piercing do not have to be performed independently of each other, and the production time is therefore further reducible. Further, there is no need to provide any drive source for moving the pierce die 7*b* forward or backward. Thus, a low-cost press apparatus 1 is provided.

In the embodiment of the present invention described above, the steel plate 10 is heated to a hardening temperature. However, this is only a non-limiting example. Alternatively, the steel plate 10 may be heated to such a temperature that does not cause hardening when the steel plate 10 is being pressure-held, and such a softened steel plate 10 may be pressed and turned into an initially formed product. Thereafter, this initially formed product may be pressure-held so that it is cooled and hardened, and then be machined during this pressure holding, thereby obtaining a final product.

The press apparatus 1 of the present invention may also be used for pressing a high tensile strength steel plate. That is, a high tensile strength steel plate may be pressed and turned into an initially formed product. Then, this initially formed product may be machined while being pressure-held to obtain a final product. This allows for a reduction in springback of the final product, and the accuracy of the parts is improvable.

Furthermore, in the embodiment of the present invention described above, the coupling member 7*c* couples two of the trim dies 7*a* facing each other. However, the coupling member 7*c* may couple at least two trim dies facing each other among the plurality of trim dies 7*a*.

Furthermore, the embodiment of the present invention described above has a single pierce die 7*b*. However, a plurality of pierce dies 7*b* may be provided as well.

Also, in the embodiment of the present invention described above, the trim dies 7*a* and the pierce die 7*b* respectively cut off the outer peripheral portions of the initially formed product 10*a* and make a hole at the same time. Alternatively, the trim dies 7*a* alone may be provided to cut off the outer peripheral portions of the initially formed product 10*a*, with the pierce die 7*b* omitted. Still alternatively, the pierce die 7*b* alone may be provided to form a hole in the initially formed product 10*a* with the trim dies 7*a* omitted.

Further, in the embodiment of the present invention described above, the rods 8 are fixed to the sides of the trim dies 7*a*, but may be provided on the platform 3 as long as the rods 8 move downward synchronously with the downward movement of the trim dies 7*a*.

The present invention is suitable for a press apparatus which presses a steel plate into an initially formed product and machines the initially formed product while pressure-holding the product in order to obtain a final product.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A press apparatus comprising:

a base placed on a floor;

a platform arranged over the base to face the base and move up and down;

a lower die, which is fixed to the base and on which a steel plate is to be mounted;

an upper die fixed to the platform to press the steel plate against the lower die and turn the plate into an initially formed product through a downward movement of the platform, and to pressure-hold the initially formed product with the lower die;

a machining die supported on the platform to move up and down and to machine the initially formed product and form a final product by moving downward while pressure-holding the initially formed product between the upper and lower dies;

a plurality of rods, which are provided around and laterally with respect to the machining die, so as to extend vertically, the plurality of rods moving downward synchronously with the downward movement of the machining die;

a plurality of shock absorber means, which are fixed on the base at positions corresponding to the plurality of rods, so as to absorb a shock caused when the steel plate is pressed and a shock caused when the initially formed product is machined; and a plurality of hydraulic press machines arranged around and oriented laterally with respect to the upper die, the plurality of hydraulic press machines further being arranged between a portion of the platform and the machining die, such that the plurality of hydraulic press machines move the machining die downward, wherein:

the shock absorber means are arranged such that lower ends of the rods contact with the shock absorber means when the steel plate is pressed, and when the initially formed product is machined by the machining die that is moving down, the shock absorber means are compressed by the rods so as to absorb the shock caused by the machining of the initially formed product.

2. The press apparatus of claim 1, wherein:

the upper die is provided with a horizontally-extending through hole and a pierce hole vertically extending from the through hole to a die surface, and the machining die comprises:

a plurality of trim dies arranged around the upper die to cut off outer peripheral portions of the initially formed product, a pierce die arranged in the pierce hole to move forward and backward and make a hole through the initially formed product, and a coupling member inserted in the through hole to move up and down and connected to an upper end of the pierce die so as to couple at least two of the trim dies facing each other.

3. The press apparatus of claim 1, wherein the hydraulic press machines support the machining die such that the machining die is capable of moving upward and downward.

4. A press apparatus comprising:

a base placed on a floor;

a platform arranged over the base to face the base and move up and down;

a lower die which is fixed to the base and on which a steel plate is to be mounted;

an upper die fixed to the platform to press the steel plate against the lower die and turn the plate into an initially formed product through a downward movement of the platform, and to pressure-hold the initially formed product with the lower die;

a machining die supported on the platform to move up and down and to machine the initially formed product and form a final product by moving downward while pressure-holding the initially formed product between the upper and lower dies;

a plurality of rods, which are provided around and laterally with respect to the machining die, so as to extend vertically, and the plurality of rods moving downward synchronously with the downward movement of the machining die; and a plurality of shock absorber means, which are fixed on the base at positions corresponding to the plurality of rods, so as to absorb a shock caused when the steel plate is pressed and a shock caused when the initially formed product is machined, wherein:

the shock absorber means are arranged such that lower ends of the rods contact with the shock absorber means when the steel plate is pressed, the machining die includes a plurality of trim dies which are arranged around, and laterally with respect to, the upper die, and which cut off outer peripheral portions of the initially formed product, each of the plurality of rods is fixed to an outer peripheral surface, in a lateral direction, of an associated one of the trim dies, so as not to make a relative movement with respect to the associated one of the trim dies, and the lower ends of each of the plurality of rods are positioned below a die surface of the upper die.

* * * * *